United States Patent [19]

Maguire

[11] 4,185,948

[45] Jan. 29, 1980

[54] PERISTALTIC PUMP CONSTRUCTION

[76] Inventor: Stephen B. Maguire, 1549 E. Street Rd., Glen Mills, Pa. 19342

[21] Appl. No.: 855,815

[22] Filed: Nov. 30, 1977

[51] Int. Cl.[2] ..... F04B 43/12; F04B 45/12

[52] U.S. Cl. ..... 417/477

[58] Field of Search ..... 417/477, 476, 475, 474

[56] References Cited

U.S. PATENT DOCUMENTS

| | | | |
|---|---|---|---|
| 2,102,523 | 12/1937 | Ferrara et al. | 417/477 X |
| 2,314,281 | 3/1943 | Knott | 417/477 |
| 2,332,157 | 10/1943 | Mapson | 417/475 X |
| 2,651,269 | 9/1953 | Bruckmann | 417/476 X |
| 2,898,859 | 8/1959 | Cornel | 417/475 X |
| 2,899,905 | 8/1959 | Becher | 417/476 X |
| 2,909,125 | 10/1959 | Daniels | 417/477 |
| 3,584,983 | 6/1971 | Hindman et al. | 417/476 |
| 3,674,383 | 7/1972 | Iles | 417/476 |

*Primary Examiner*—Richard E. Gluck
*Attorney, Agent, or Firm*—Robert K. Youtie

[57] ABSTRACT

A peristaltic pump construction wherein a body is provided with a generally cylindrical recess having eccentric roller means mounted in the recess for rotation about the axis of the latter, and a conduit circumposed about the roller means within the recess being collapsed by the roller means upon rotation of the latter, the conduit means being relatively stiff and heavy walled, and a side member being engageable across the recess for forcibly engaging a conduit about the roller means laterally into the recess.

10 Claims, 8 Drawing Figures

FIG. 1
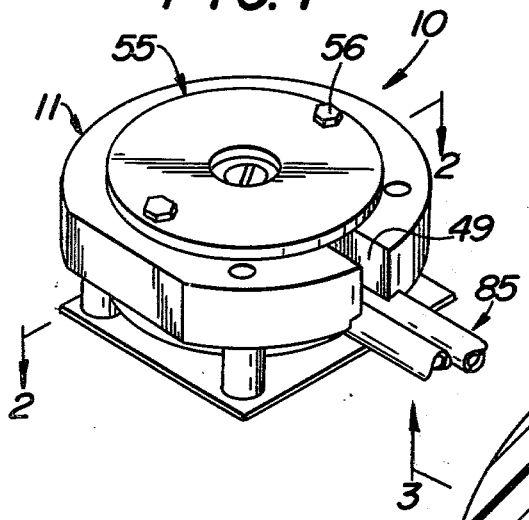
FIG. 2
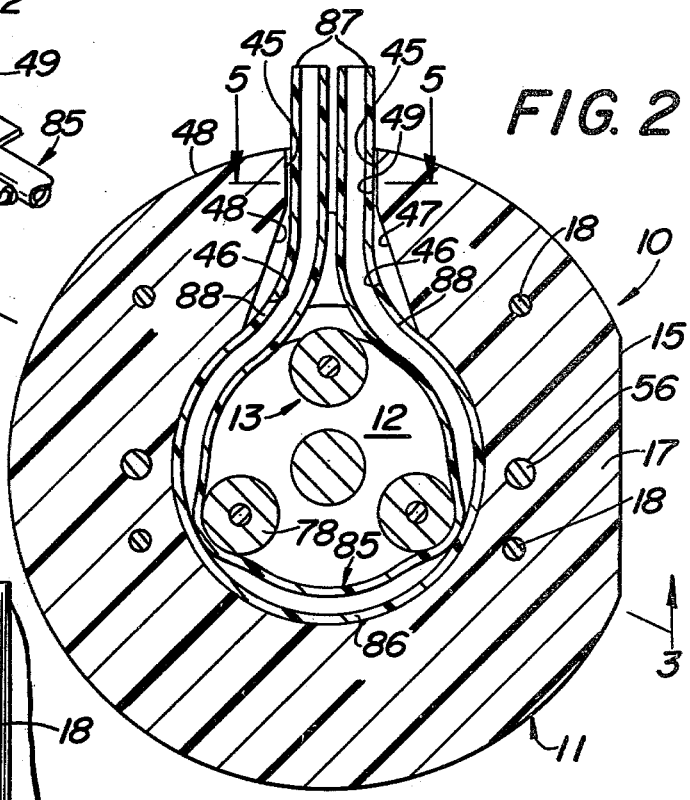
FIG. 4
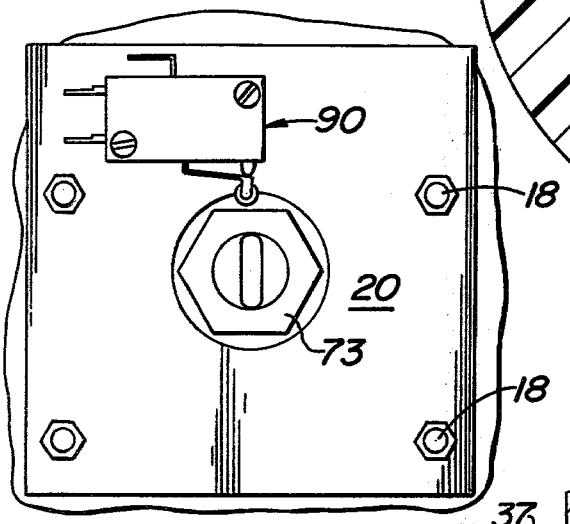
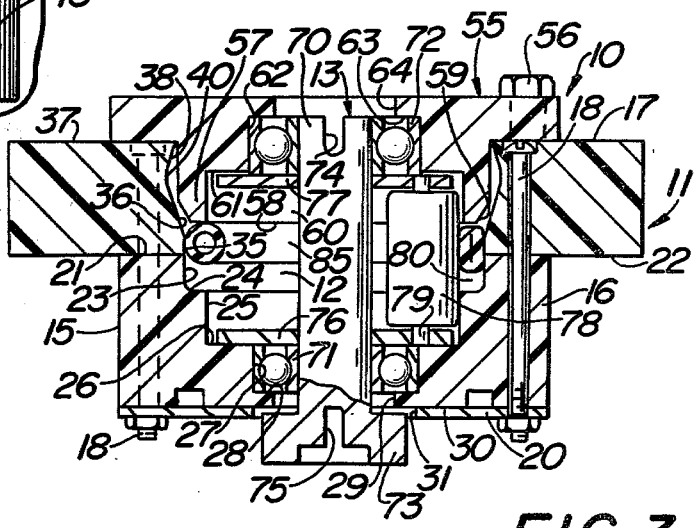
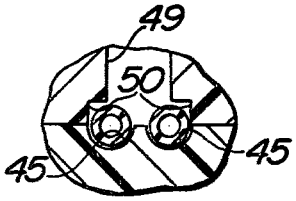
FIG. 5
FIG. 3

PERISTALTIC PUMP CONSTRUCTION

BACKGROUND OF THE INVENTION

As is well known to those versed in the field of pumps, peristaltic type pumps have in the past afforded certain advantages, including high sanitation as the fluid contacted only the interior of the conduit being flexed, with resultant ease of changing fluids without contamination of one by the other. However, such pumps were, in the past, lacking in sufficient pumping precision for certain applications, and the changing of conduits to avoid fluid contamination of one another was usually a difficult and time consuming procedure.

SUMMARY OF THE INVENTION

It is an important object of the present invention to provide improvements in peristaltic type pumps which greatly extend the practical applicability of such pumps by insuring an extremely high degree of precise metering while permitting of quick and easy change of the peristaltic conduit to avoid fluid contamination and spillage.

It is another object of the present invention to provide a peristaltic pump construction wherein a relatively stiffly resilient peristaltic conduit may be used for precise and accurate pumping, and which may be removed and replaced by a simple and expeditious procedure requiring no special skill, strength or tools.

While the peristaltic pump of the present invention has been primarily developed and employed for use in the metering of coloring liquid to plastic extrusion and molding apparatus, and again will be described and illustrated herein with particular reference thereto. It is appreciated that the instant pump is capable of many varied applications, all of which are intended to be comprehended herein.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a pump of the present invention.

FIG. 2 is a horizontal sectional view taken generally along the line 2—2 of FIG. 1.

FIG. 3 is a transverse sectional view taken generally along the line 3—3 of FIG. 2.

FIG. 4 is a bottom view of the pump of FIG. 1.

FIG. 5 is a partial sectional view taken generally along the line 5—5 of FIG. 2.

DESCRIPTION OF THE PREFERRED EMBODIMENTS

Figure 6:
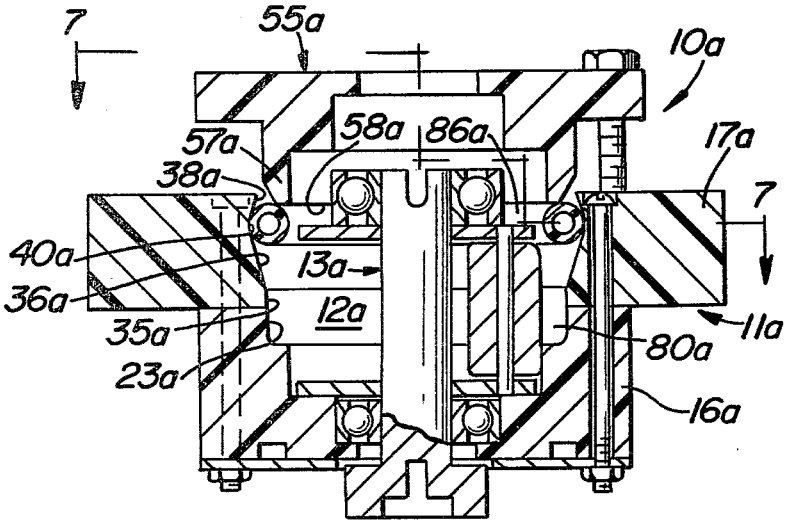
FIG. 6 is a transverse sectional view similar to FIG. 3, but showing a slightly modified embodiment of pump in accordance with the instant invention, and illustrating an intermediate stage in setting up of the pump for operation.

Referring now more particularly to the drawings, and specifically to FIGS. 1–3 thereof, a pump of the present invention is there generally designated 10, and may include a housing generally designated 11 which may enclose an inner chamber 12 having rotatably mounted therein a roller assembly 13 for powered rotation by suitable motive force.

More specifically, the housing or casing 11 may include a sectional body part 15 composed of an inner section 16 and secured fast thereto an outer section 17. The inner section 16 and outer section 17 may be secured in facing engagement, as by a plurality of spaced tie members, fasteners or bolts 18, extending entirely through the sections 16 and 17, and through a mounting plate 20 externally of and in facing engagement with the inner side of section 16. The fasteners 18 may be arranged in any suitable configuration, such as the rectangular configuration illustrated in FIGS. 2 and 4, and the plate 20 may also be of suitable configuration, such as the rectangular configuration shown in FIGS. 1 and 2.

The body section 16 may have one side or surface 21, opposite to and remote from the plate 20, generally parallel thereto, and substantially flat for facing engagement with the adjacent surface 22 of the section 17. Centrally of the body section 16, opening through the surface 21, there is formed a generally cylindrical bore 23 terminating inwardly in a concentric, annular shoulder 24. Concentric with respect to the cylindrical bore 23, and extending inwardly from the shoulder 24, may be a cylindrical bore 25, of reduced diameter with respect to the bore 23, and terminating inwardly in a concentric, outwardly facing annular shoulder 26. The body section 16 is further formed with a generally cylindrical internal bore 27, concentric with the bores 23 and 25, and of further reduced diameter, terminating inwardly in a concentric, annular shoulder 28. Extending from the shoulder 28, generally concentric therewith, is a through bore or hole 29, opening inwardly through the inner side of body section 16, specifically through the inner side surface 30 against which the plate 20 abuts. The plate 20 may be provided with a generally central through aperture or opening 31, concentric with the opening or passageway 29, for a purpose appearing presently.

The additional section 17 of body part 15 may be formed with a generally central, cylindrical through bore 35, opening through its surface 22 abutting the section 16, and in congruent alignment with the cylindrical bore 23. From the generally cylindrical internal surface of bore 35, there extends a generally flaring, gradually enlarging conical internal surface 36 which terminates short of the opposed outer side surface 37 of body section 17. From the outwardly flaring surface of enlarging opening or bore 36, there may extend a reducing or tapering bore defined by a generally conical internal surface 38 generally coaxial with the adjacent surface 36. The outwardly reducing surface 38 may open through the outer surface 37 of section 17. Thus, the internal flaring and reducing surfaces 36 and 38 may combine to define at their juncture and adjacent thereto an annular internal groove 40.

It will now be appreciated that the aligned cylindrical bore surfaces 23 and 25, may be considered as combining to define the internal cylindrical wall of recess 12, from which the gradually enlarging surface 36 may be considered as a flaring portion. The reducing or tapering wall surface 38 terminates at its juncture with the section 37 having an internal diameter greater than the internal diameter of walls 23 and 35 of recess 12.

In addition, the inner section 16 of body part 15 is formed on its surface 21 with a pair of grooves 45 extending generally radially outwardly from the cylindrical wall surface 23, as seen in FIGS. 2 and 5. The pair of grooves 45 may be generally parallel, opening radially inwardly into the recess 12 and radially outwardly beyond the exterior of body part 15. The radially inner regions of grooves 45 may diverge into smooth merging, somewhat tangential relation with the adjacent portions of internal cylindrical surface 23, as at 46, in FIG. 2.

The body section 17, directly over the grooves 45, may be formed with a generally radially extending through slot or cut 47, opening radially inwardly through the cylindrical internal surface 35, and radially outwardly through the peripheral surface 48 of the body section 17. As best seen in FIG. 2, the generally radial slot or kerf 47 may include an inner portion 48 tapering radially outwardly to an outer portion 49 of generally constant internal dimension and overlying the parallel regions of grooves 45. Further, the outer slot region 49 may have its opposite sides undercut, as at 50, so as to at least partially overlie respective grooves 45.

Extending across the outer open side of body part 15 is a side member, cover or closure, generally designated 55. That is, the side member or cover 55 may be generally flat, removably disposed in facing engagement with the outer side surface 37 of body section 17 extending across the open side of recess 12. Suitable fastener means such as threaded members 56 may removably secure the side member or cover 55 in fast facing engagement with the outer side of body section 17. In practice, the side member or cover 55 may constitute a disc, and the fasteners 56 may be two in number located at diametrically opposed regions of the side member, and threadedly engaged into the underlying regions of body section 17.

A generally annular or circular wall, rib or projection 57 depends from the inner side of cover 55 into the recess or central opening 12, terminating at an annular end wall or engaging surface 58 proximate to but short of the internal cylindrical surface 35. The depending annular projection or wall 57 may have an external diameter approximating the internal diameter of the tapering or convergent wall surface 38 at its juncture with the outer side surface 37, and may have its distal region circumferentially tapered or beveled, at at 59 to the end edge or surface 58.

The annular projection 57 may bound a generally cylindrical internal surface 60, of an internal diameter approximating that of and substantially aligned with the internal cylindrical surface 25. The internal cylindrical surface 60 may extend from the projection end edge 58 to an internal, downwardly facing shoulder 61, which is provided with a reduced diameter internal cylindrical bore 62 generally concentric with and of a diameter approximating that of internal cylindrical bore 27. The bore 62 terminates in an internal annular shoulder 63, which extends radially inwardly to a concentric, through opening or hole 65.

The roller assembly 13 may include a central, axial shaft 70 rotatively supported adjacent to opposite ends by respective inner and outer journal bearings 71 and 72, which may be anti-friction bearings as illustrated, or other, and which are respectively seated within internal cylindrical surfaces 27 and 62. One end of the shaft 70 may be provided with a cam 73, such as a concentric polygonal cam shown in FIG. 4, and one or both ends of the shaft may be provided with a noncircular groove or keyway, as at 74 and 75, as for coupling to a drive motor (not shown).

Within the internal cylindrical surface 25, adjacent to the bearing 71, there may be fixedly circumposed about the shaft 70 a radially outwardly projecting roller carrier or plate 76. Similarly, within the internal cylindrical surface 60, fixedly circumposed about the shaft 70 adjacent to the bearing 72 may be a radially extending, generally circular roller carrier or plate 77. The roller carriers or plates 76 and 77 are in the nature of spiders, and may carry a plurality of rollers, as at 78 arrayed in angularly spaced relation about and journaled eccentrically with respect to the shaft 70. As in the illustrated embodiment, three roller 78 may be arranged in parallelism with each other and the shaft 70, spaced 120° apart about the shaft, and each provided concentrically thereof with a longitudinally extending roller shaft 79 having its opposite ends mounted in respective carrier plates or discs 76 and 77. Thus, the several rollers 78 are eccentrically rotatable together about the axis of shaft 70, and freely rotatable about their individual axes of respective roller shafts 79. As best seen in FIG. 3, the rollers 78 are each of a diameter so as to closely approach the internal cylindrical surfaces 25 and 60, remaining appreciably spaced from the flush internal cylindrical surfaces 23 and 35, as by a generally annular space 80.

A conduit, tube or hose is generally designated 85, and include a medial portion 86 extending arcuately about the annular space 80 between the internal cylindrical walls 23, 35 and the rollers 78 of roller assembly 13. From the annular space 80, the conduit 85 extends, as by a pair of end portions 87, from the medial portion 86 generally radially outwardly through the grooves 45 and cut 49 beyond the housing or casing 11. Thus, it will be appreciated that the pair of grooves 45, 46 combine with the cut or slot 47, 48 and 49 to define a generally radially outwardly extending passage between the interior of recess 12 and exterior of the housing 11. Further, the passage means 45–47 may converge or taper in its radially outward direction for conformably receiving smoothly arcuately bent merging portions 88 of the conduit 85.

The conduit 85 is advantageously of a relatively stiffly resilient characteristic. For this end, it has been found advantageous to utilize conduit material having a durometer of between 78A and 88A. In practice, a tubing material of rated 83 Shore A hardness, using ASTM Test No. D2240 has been found entirely satisfactory, the production tolerances being about ±2 points of durometer and entirely acceptable.

The tubing material found most advantageous is polyurethane plastic, and it has been found desirable to employ a relatively heavy wall tubing. For this purpose, a tubing wall thickness of between one-third and two-thirds the internal diameter has been found satisfactory, a tubing wall thickness of about one-half the internal diameter being employed in practice.

As best seen in FIGS. 2 and 3, the space between each roller 78 and the radially outward internal wall surfaces 23 and 35 is approximately twice the wall thickness of the tubing 85, so that the rollers engage the tubing to substantially completely collapse the latter at the points of engagement. Upon rotation of shaft 70 of roller assembly 13, to rotate the rollers about the shaft 70 in their rolling engagement with the conduit 85, the collapsed regions are sequentially moved along the medial portion of conduit 86 to effect peristaltic pumping action in the known manner.

Of course, suitable connection means may be provided on the end portions 87 of conduit 85 for pumping a desired fluid, such as coloring to a plastic extruder or the like.

The polygonal cam 73, upon rotation of shaft 70, actuates a switch 90 which may operate a counter (not shown) operative to discontinue pump operation when a predetermined count is achieved corresponding to a desired quantity of fluid pumped. This type of metering has been found highly accurate and may, of course, be adjusted with great precision.

When it is desired to change the fluid pumped, and avoid contamination between fluids, it is only necessary to replace the conduit 85 with a different conduit free of contaminating fluid. This is accomplished by removal of fasteners 56 and withdrawal of side member or cover 55. The conduit 85, and specifically one end portion 87 may then be withdrawn outwardly through the slot 49 past the internal surfaces 36 and 38 out of the recess 12. In particular, the slot 49 is sufficiently wide to pass one end portion 87 of the conduit 85 when deliberately withdrawn. However, the conduit end portions are, in use, effectively retained in respective grooves 45 by the undercuts 50.

In replacement of a conduit 85, the medial conduit portion 86 may be engaged in the internal groove 40, with the end portions 87 in respective grooves 45. It is then only necessary to place the side member or disc 55 in position across the opening of recess 12, with the arcuate projection 57 having its distal edge or surface 58 bearing against the medial conduit portion 86. By the tightening of fasteners 56, the arcuate projection 57 is moved inwardly, and serves to displace the engaged medial conduit portion 86 inwardly along the conical internal wall surface 36 to thereby gradually collapse conduit portions engaging rollers 87 and displace the conduit into the annular space 80, the condition illustrated in FIGS. 2 and 3.

Figure 8:
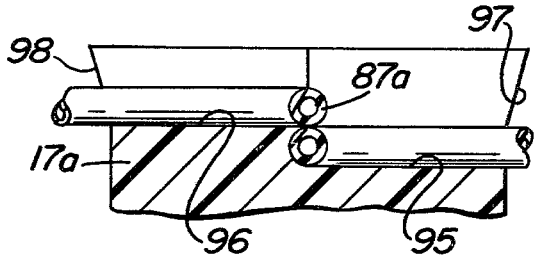
FIG. 8 is a sectional view taken generally along the line 8—8 of FIG. 7.
Figure 7:
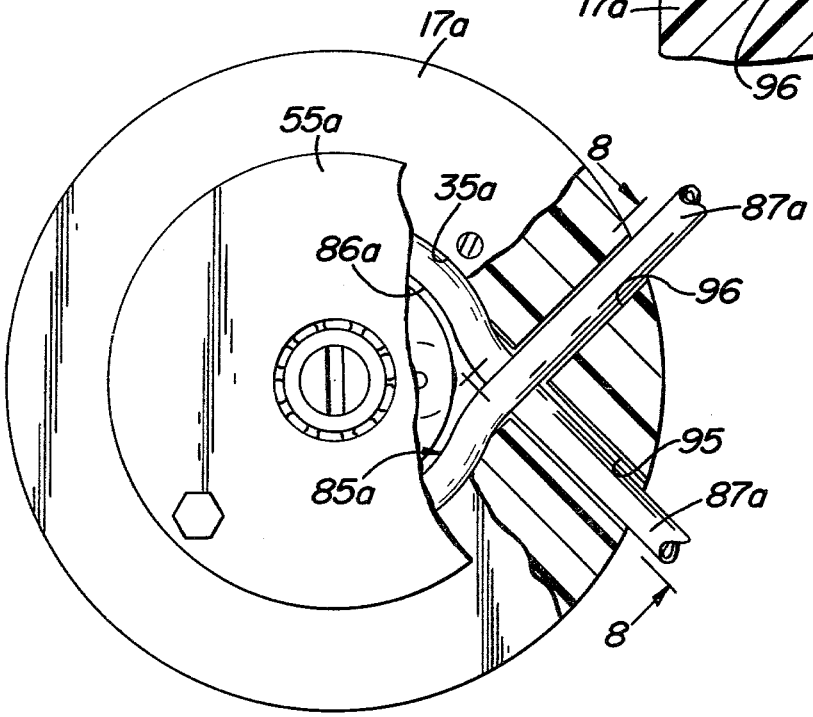
FIG. 7 is a partial sectional view taken generally along the line 7—7 of FIG. 6 illustrating the modification thereof.

The embodiment shown in FIGS. 6–8 is a slight modification of the hereinbefore described embodiment of FIGS. 1–5. The pump 10*a* of FIG. 6 includes a housing or casing 11*a* constituted of sections 16*a* and 17*a*. The sections 16*a* and 17*a* may combine to define a central recess 12*a*, similar to the recess 12 of the first described embodiment and receiving a roller assembly 13*a* which may be identical to the roller assembly 13. The recess 12*a* may included internal cylindrical wall surfaces 23*a* and 35*a*, as well as the outwardly flaring internal conical surface 36*a* and outwardly tapering internal conical surface 38*a*. The conical surfaces 36*a* and 38*a* may combine to define an internal circumferential groove 40*a*, all substantially identical to the first described embodiment.

Also, the side member or cover 55*a* may be substantially identical to the side member 55, including a generally annular or arcuate projection 57*a* having a conduit engaging distal end surface or edge 58*a*.

However, rather than the single generally radial passage 45–47, the housing section 17*a* may be formed with a pair of generally tangential crossing grooves, cuts or passageways 95 and 96. That is, as best seen in FIG. 7, the passageways 95 and 96 are each generally tangent to the internal cylindrical surfaces 35*a*, extending in crossing relation with respect to each other for receiving respective crossing end portions of conduit 85*a*. The crossing relationship of receiving passages or grooves 95 and 96 is arranged such that the intermediate portion 86*a* of conduit 85*a* defines a substantially complete annulus between the end portions 86*a*. Further, one of the passages or grooves 95 may be of a depth greater than that of the other passageway or groove 96, so that one conduit end portion passes beneath the other without conduit constriction.

In the embodiment of FIGS. 6–8, conduit replacement is essentially the same as that described hereinbefore, removal of the side member 55*a* exposing the upper end portion 87*a* to being grasped and withdrawn from its receiving passageway 96, as well as the recess 12*a*, and subsequent removal of the remaining end portion 87*a* from its receiving conduit 95. In practice, the grooves 95 and 96 are preferably each slanted downwardly, witness the groove side edges 97 and 98 in FIG. 8, so as to resist the unwinding or restorative straightening force of the received conduit end portions. That is, by the oblique disposition of groove edges 97 and 98, the resilient restoring forces of the received conduit end portions tend to urge the same downwardly into the grooves.

In the condition shown in FIG. 6, it will be apparent that the medial tube portion 86*a* is received in groove 40*a*, and insertion of the tube by the projection 57 is beginning. Upon continued downward or inward movement of the side member 55*a*, the medial tube portion 86*a* is displaced along the inwardly convergent internal wall surface 36*a* to collapse the received tube portion into the space 80*a* to its fully inserted condition shown in FIGS. 2 and 3.

From the foregoing, it is seen that the present invention provides a peristaltic pump construction which is extremely simple in structure and operation, highly accurate and precisely adjustable in its metering, extremely simple and easy to convert between fluids without contamination of one by the other and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A peristaltic pump construction comprising a body part having a recess extending from one body side into said body part and bounded by a generally cylindrical internal side wall having a generally circular cross-section, eccentric roller means mounted in said recess for rotation about the axis of and in spaced relation within said internal side wall, passage means extending outwardly through said internal side wall and opening from said body part, a resiliently collapsible conduit removably extending about said roller means in the space between the latter and said internal side wall and having end portions extending outwardly through said passage means, said conduit being substantially collapsed in the space between said roller means and internal side wall for peristaltic action on roller means rotation, a side member removably secured across said recess, and a projection on said side member entering into the space between said roller means and internal side wall for engaging said conduit in said space.

2. A peristaltic pump construction according to claim 1, said internal side wall having an outwardly flaring portion adjacent to said one body side, for gradual collapse of said conduit upon lateral engagement into said space.

3. A peristaltic pump construction according to claim 1, said passage means comprising a passageway converging in the direction away from said recess, for smooth exit of said conduit end portions.

4. A peristaltic pump construction according to claim 3, said passageway being undercut to receive said conduit end portions in side by side relation generally coplanar with the remainder of said conduit and prevent side by side removal of said end portions from self retention therein.

5. A peristaltic pump construction according to claim 1, said projection comprising an arcuate flange for conforming entry into said space.

6. A peristaltic pump construction according to claim 1, said conduit being of generally circular cross section.

7. A peristaltic pump construction according to claim 6, said conduit having a durometer of between 78A and 88A.

8. A peristaltic pump construction according to claim 6, said conduit having a wall thickness of between one-third and two-thirds of its internal diameter.

9. A peristaltic pump construction according to claim 8, said conduit being fabricated of polyurethane.

10. A peristaltic pump construction according to claim 1, said passage means comprising a pair of passageways each extending generally tangentially from said recess and in crossing relation with each other for receiving respective end portions of said conduit.

* * * * *